US006922976B2

(12) United States Patent
Correll

(10) Patent No.: US 6,922,976 B2
(45) Date of Patent: Aug. 2, 2005

(54) METHOD OF PACKAGING AND TRANSPORTING PIZZA FOR IMPROVED EFFICIENCY AND CRUSH-RESISTANCE

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 177 days.

(21) Appl. No.: 10/385,374

(22) Filed: Mar. 10, 2003

(65) Prior Publication Data

US 2003/0163978 A1 Sep. 4, 2003

Related U.S. Application Data

(63) Continuation-in-part of application No. 09/817,643, filed on Mar. 26, 2001, now abandoned, which is a continuation-in-part of application No. 09/551,245, filed on Apr. 17, 2000, now Pat. No. 6,290,122, which is a continuation-in-part of application No. 09/200,684, filed on Nov. 27, 1998, now Pat. No. 6,065,669.

(51) Int. Cl.[7] ..... B65B 5/02
(52) U.S. Cl. ..... 53/452; 53/484
(58) Field of Search ..... 53/452, 456, 458, 53/468, 484; 229/120, 169, 172, 104, 112, 152, 906, 178, 512; 206/518, 511, 512

(56) References Cited

U.S. PATENT DOCUMENTS

| | | | | |
|---|---|---|---|---|
| 1,530,644 | A | 3/1925 | Blandford | |
| 1,824,927 | A | 9/1931 | Powell | |
| 4,009,821 | A | 3/1977 | Hambleton | 229/36 |
| 4,265,393 | A | 5/1981 | Orchard | 229/40 |
| 4,765,534 | A | 8/1988 | Zion et al. | 229/109 |
| 4,804,136 | A | 2/1989 | Hall | 229/112 |
| 4,809,908 | A | 3/1989 | Keefe et al. | 229/150 |
| 4,919,326 | A | 4/1990 | Deiger | 229/109 |
| 5,000,374 | A | 3/1991 | Deiger | 229/109 |
| 5,110,039 | A | 5/1992 | Philips | 229/110 |
| 5,381,949 | A | 1/1995 | Correll | 229/198.2 |
| 5,702,054 | A | 12/1997 | Philips et al. | 229/110 |
| 5,752,651 | A | 5/1998 | Correll | 229/150 |
| 5,799,864 | A | 9/1998 | Mertz | 229/196 |
| 5,806,755 | A | 9/1998 | Correll | 229/110 |

FOREIGN PATENT DOCUMENTS

| | | |
|---|---|---|
| DE | 2804211 | 8/1979 |
| JP | 3-85244 | 4/1991 |

*Primary Examiner*—Eugene Kim
*Assistant Examiner*—John Paradiso

(57) ABSTRACT

A method of packaging and transporting pizza for improved efficiency and crush-resistance, this method involving the steps of (a) providing a box blank erectable into a non-wall-engaged carton comprising a substantially rectangular bottom panel, a rear wall, a pair of left and right side wall structures each comprising a side wall having a free top edge and opposing front and rear free-swinging corner flaps, a front wall structure comprising a front wall and an ancillary panel, and a cover comprising a cover panel, left and right interior-disposed support-bearing cover side flaps, and a cover front flap; (b) erecting the blank into the carton by a unique folding method; (c) opening the carton and, thereby, providing a particular pre-folded opened rectangular carton in non-wall-engaged mode; (d) placing a pizza into the opened carton; (e) closing the carton by a unique closing method; and (f) transporting the loaded carton.

7 Claims, 8 Drawing Sheets

FIG-6
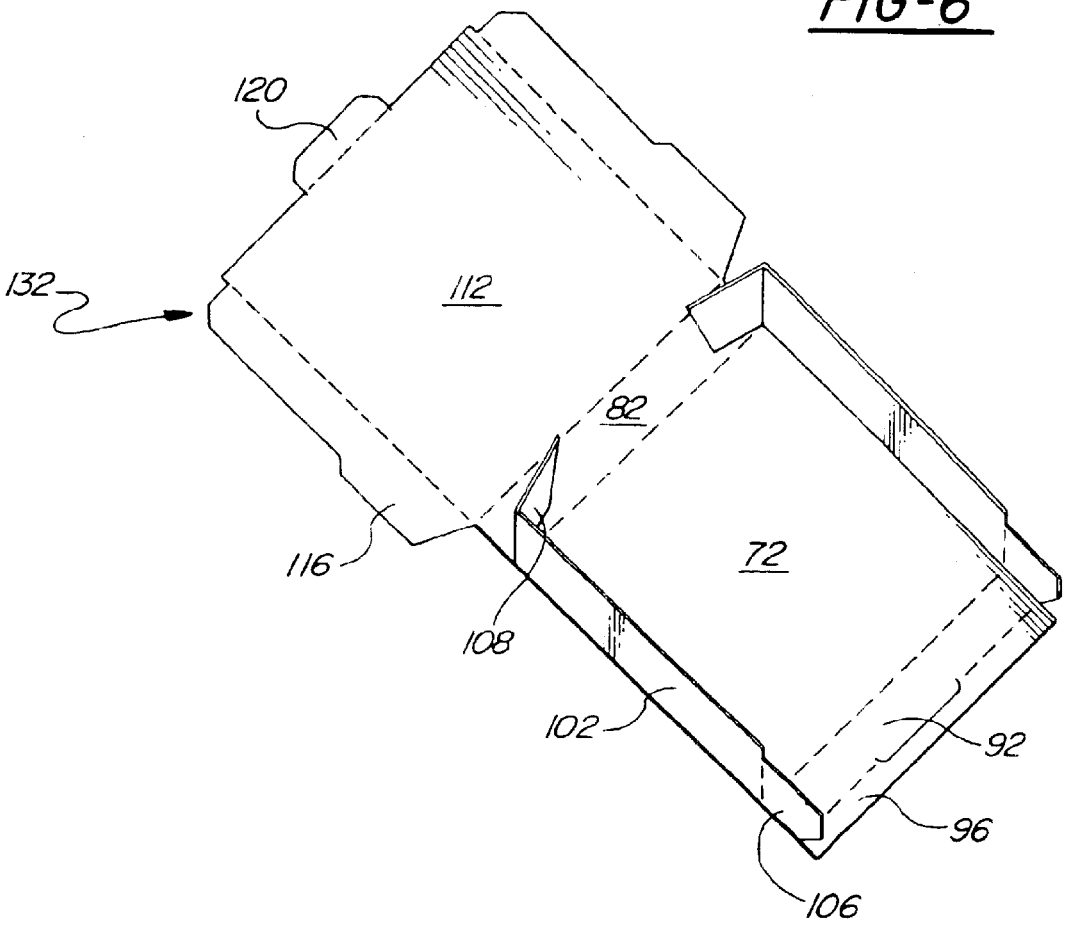
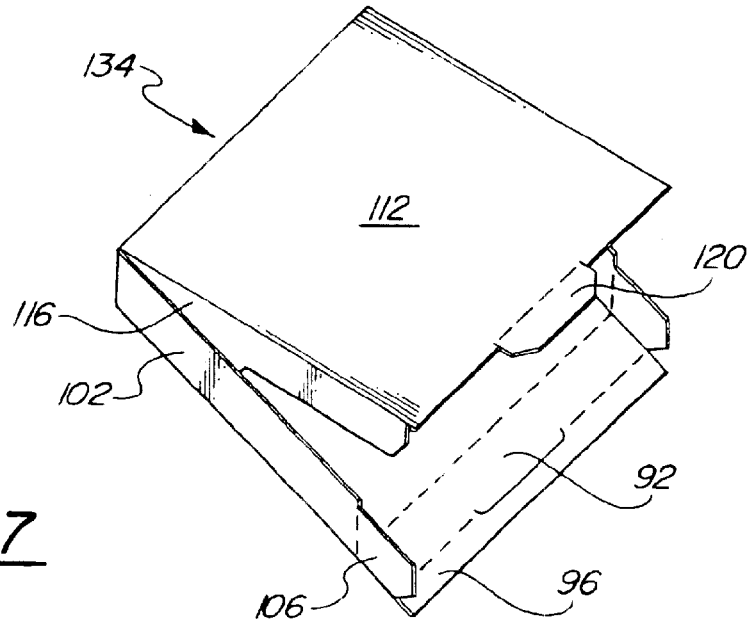
FIG-7

FIG-10
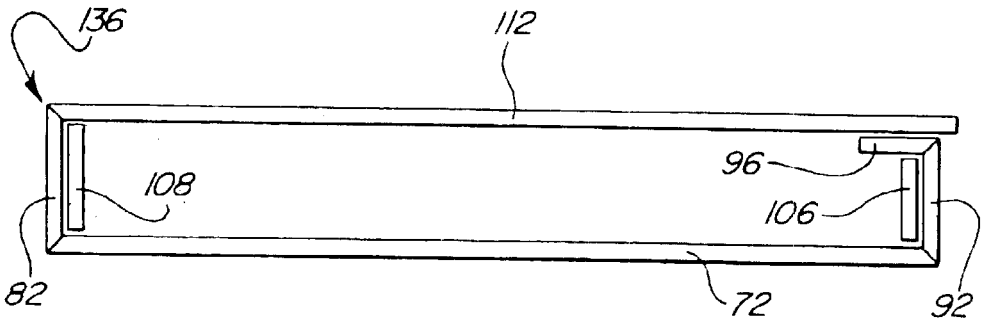
FIG-11
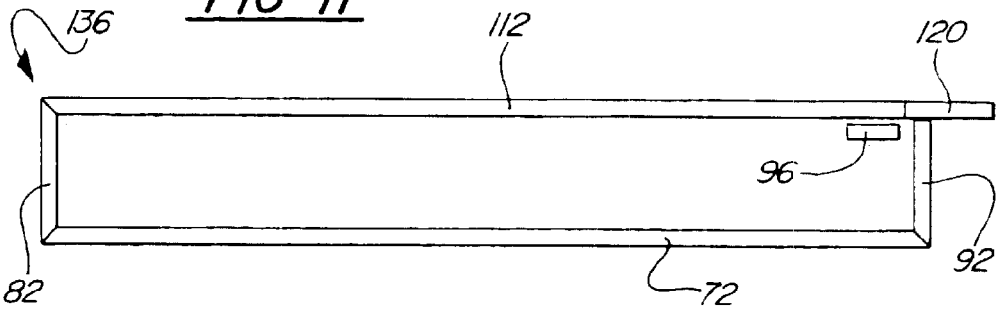
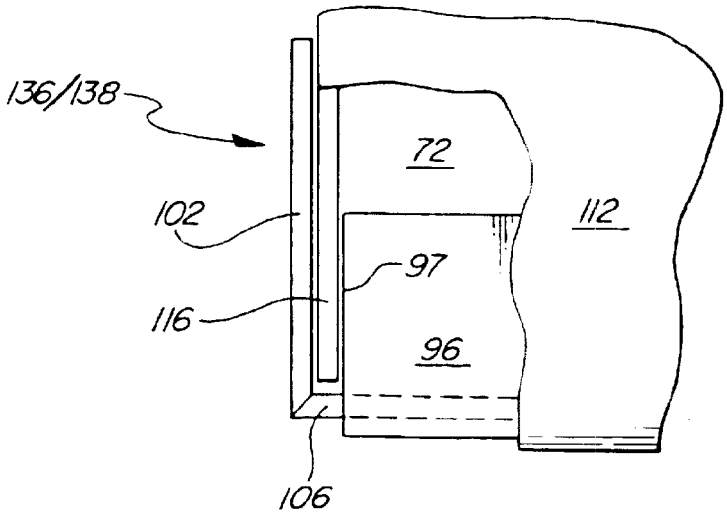
FIG-12

METHOD OF PACKAGING AND TRANSPORTING PIZZA FOR IMPROVED EFFICIENCY AND CRUSH-RESISTANCE

CROSS-REFERENCES TO RELATED APPLICATIONS

This is a continuation-in-part of application Ser. No. 09/817,643, entitled "Method of Readying a Pizza for Transport," filed Mar. 26, 2001, (abandoned), which is a continuation-in-part of application Ser. No. 09/551,245, entitled "Versatile Pizza Carton," filed Apr. 17, 2000, now U.S. Pat. No. 6,290,122, which is a continuation-in-part of application Ser. No. 09/200,684, entitled "Slanting-wall Pizza Box," filed Nov. 27, 1998, now U.S. Pat. No. 6,065,669.

FIELD OF THE INVENTION

This invention relates to packaging methods in general and, in particular, to methods of packaging and transporting pizza and the like.

DESCRIPTION OF THE PRIOR ART

Each year millions of hot pizzas are sold for delivery and carry-out by pizzerias and other food service establishments (those pizzas often being referred to as "pizzeria pizzas"). These pizzas are transported from a place of preparation (e.g., the pizzeria) to an outlying place of consumption (e.g., consumer residence). The most common method used for packaging and transporting these pizzas comprises six basic steps:

(a) providing a pizza box blank;

(b) erecting the pizza box blank into a carton and stacking it with other cartons;

(c) extracting the carton from the stack and opening it, whereby a pre-folded pizza carton in opened disposition is provided;

(d) placing a pizza into the opened pizza carton and, perhaps, cutting the pizza with a rocker knife or other cutting implement;

(e) closing the opened pizza carton into a closed pizza carton loaded with pizza; and (f) transporting the closed carton loaded with pizza.

How this method is implemented impacts the operational efficiency of the business as well as the quality of the transported pizza. And the type and structure of pizza carton employed for use in the method substantially effects how the method is implemented.

Pizza cartons can be categorized into two groups based on geometric shape: rectangular and non-rectangular. Cartons in the rectangular group have a substantially rectangular bottom panel (as viewed from top or bottom view). Those in the non-rectangular group have a non-rectangular bottom panel (e.g., pentagonal, hexagonal, heptagonal, octagonal). My invention relates to cartons in the rectangular category.

Pizza cartons can further be categorized into two groups based on mode of wall engagement, which are (1) wall-engaged mode and (2) non-wall-engaged mode. As the terms are used herein, a carton in wall-engaged mode, which can be called a wall-engaged carton, is one in which at least two wall structures of the carton are engaged one to the other. This engagement enables the particular wall structures to remain upright when the carton cover is in opened disposition, or when the cover has been removed or laid back from the top of the carton. A prime example of a wall-engaged pizza carton is the standard square pizza box with the double-panel front wall structure that consists of an inner panel disposed parallel to an outer panel. In this carton, corner flaps attached to the front end of the side walls are enclosed between the inner and outer panels, thereby engaging the front wall structure with each of the side wall structures. A prior art box blank used for making this carton is shown in FIG. 1.

A carton in non-wall-engaged mode, which can be called a non-wall-engaged carton, is one in which none of the wall structures are engaged one to another. This situation results in each of the wall structures being easily pushed to a horizontal position (i.e., coplanar to the bottom panel) when the carton cover is in opened disposition. Therefore, the distinguishing difference between the wall-engaged and non-wall-engaged modes (or between wall-engaged and non-wall-engaged cartons) pertains to whether one or more of the wall structures is engaged to another wall structure when the cover of the carton is in opened disposition. With a carton in non-wall-engaged mode, none of the wall structures are engaged with one another. With a carton in wall-engaged mode, at least one of the wall structures is engaged with another wall structure when the carton cover is open. In addition, it is noted that it's possible to erect certain box blanks into a non-wall-engaged carton and, subsequently, unfold the carton and re-fold it into a wall-engaged carton. This invention is shown in my U.S. Pat. No. 6,290,122 (Versatile Pizza Carton).

The instant invention relates to pizza box blanks that can be erected into a non-wall-engaged pizza carton.

As described above, the second step of the pizza packaging and transporting method involves erecting a pizza box blank into a carton. Each particular type of box blank involves a particular folding method. As such, the prior art contains a number of differing folding methodologies. Some of those prior art folding methods, as well as the corresponding box blanks, will now be described.

The most common folding method involves the standard wall-engaged pizza box with the double-panel front wall structure. This method involves creating a carton from a box blank having the general configuration or components shown in blank 12 of FIG. 1. The method of folding the blank into a carton involves the steps of: (a) folding left and right side walls 13 to an upright position and left and right front corner flaps 14 to an inward position, (b) folding outer panel (or front wall) 16 to an upright position and inner panel (or ancillary panel) 18 to a downward position parallel to wall 16, whereby inner panel 18 locks into slots in bottom panel 20 and corner flaps 14 are enclosed between wall 16 and panel 18, thereby creating a locking engagement between the side wall structures and the front wall structure, resulting in a wall-engaged carton, (c) folding left and right rear corner flaps 22 to an inward position, (d) folding cover panel 24 to a forward position and left and right cover side flaps 26 to an inward position whereby the flaps are disposed interior to side walls 13, and (e) closing the cover on the box. In performing step (e), cover front flap 28 is handled one of two ways. Either it's left outside of the box cavity (i.e., co-planar to cover panel 24) or it's folded into the box cavity. When left outside (for purposes of easily extracting the box from a stack), the flap is eventually folded into the cavity after a pizza has been loaded into the box.

The creation of virtually every wall-engaged pizza carton having a double-panel wall structure involves a variation of this folding method, in that the method involves forming a locking engagement between walls by enclosing a corner flap from one wall between parallel inner and outer panels of an adjacent double-panel wall structure.

Another type of wall-engaged pizza carton is disclosed by Mertz U.S. Pat. No. 5,799,864 granted Sep. 1, 1998. The folding method for this box, which is depicted in FIGS. 2A through 2J of the patent, involves the steps of: (a) folding front corner flaps (32) along a diagonal fold line (37) so that the bottom half of the flap projects at an angle to the top half, (b) folding the front corner flaps inward and downward, thereby pulling side walls (16) to upright position, (c) folding front wall (12) to upright position and top panel (20) downward, (d) pulling the side walls outward so that tabs **(36*a*) projecting from the top of the front corner flaps engage with openings (25) in the top panel (whereby a locking engagement between the side wall structures and front wall structure is formed, resulting in a wall-engaged carton), (e) pushing the bottom half of the front corner flaps up against the front wall so that tabs (36*b*) projecting from the bottom of the front corner flaps engage with openings (25*a*) in the bottom panel, (f) folding rear corner flaps (30) inward, (g) pulling cover panel (50) forward while folding cover side flaps (52) inward and interior to the side walls, and (h) tucking cover front flap (54) into cover front flap receiving slot (57)**.

It is noted that some wall-engaged pizza cartons are of such a structure that the engaged walls can be easily disengaged. Three examples are Powell U.S. Pat. No. 1,824,927 granted Sep. 29, 1931; Correll U.S. Pat. No. 5,381,949 granted Jan. 17, 1995; and Correll U.S. Pat. No. 5,806,755 granted Sep. 15, 1998. However, it is pointed out that, even though the engaged walls in these cartons can be easily disengaged, the cartons are still of the wall-engaged genre.

Associated with each of these boxes is a particular folding method. Powell's folding method, which is used for creating a bacon box, involves the steps of: (a) folding left and right side walls (8, 9) to an upright position, (b) folding rearward locking strips (24, 26) inward and engaging the strips together for the purpose of maintaining the upright position of the side walls (whereby a locking engagement is created between the strips, resulting in a wall-engaged carton), (c) folding forward locking strips (25, 27) inward and into engagement one to the other, (d) folding end flaps (10, 11) which are attached to the top of the side walls downward, (d) folding an inside cover member (36) inward and downward, and (e) folding the cover panel (32) forward and inserting cover front flaps (33) into cover front flap receiving openings (35).

The folding method for the Correll '949 box blank involves the steps of: (a) folding side walls (14, 16) to an upright position, (b) folding front wall (34) to a position in which hooked-shaped tabs (42) projecting from the front end of the side walls pass through openings (44) in the front wall, (c) moving the side walls outward to engage the hook-shaped tabs with the openings (whereby a locking engagement between the side wall structures and front wall structure is formed, resulting in a wall-engaged carton), (d) folding rear corner flaps (28, 32) inward, and (e) pulling the cover panel (22) forward while folding cover side flaps (24, 26) inward and interior to the side walls of the carton.

A folding method for Correll '755 involves the steps of: (a) folding side walls (41) to an upright position and front corner flaps (46) inward, (b) folding front wall panel (51) upright and ancillary panel (52) approximately perpendicular to the front wall panel, (c) pulling the side walls outward until tabs (48) projecting from the top edge of the front corner flaps engage with slots (54) in the ancillary panel (whereby a locking engagement between the side wall structures and front wall structure is formed, resulting in a wall-engaged carton), (d) after placing product into the carton, folding the ancillary panel downward until tabs (59) projecting from the bottom of the ancillary panel engage in openings in the bottom panel (21), (e) folding rear corner diagonal panels (61) inward, and (f) pulling cover panel (71) forward and folding cover side flaps (81) inward and interior to the side walls and inserting cover front flap (88) into slot (55) in the front wall.

In addition to the above folding methods, which pertain to wall-engaged cartons, the prior art contains a folding method involving a non-wall-engaged rectangular carton. This method involves creating a pizza carton from a pizza box blank having the general configuration or components shown in blank 30 of FIG. 2. The method of folding the blank into a carton involves the steps of: (a) folding left and right side walls 32 perpendicular to bottom panel 34 and folding side top flaps 36 perpendicular to walls 32, (b) folding cover panel 38 forward to a position where it overlies side top flaps 36, (c) folding front wall 40 perpendicular to bottom panel 34 and folding front top flap 42 perpendicular to wall 40, and (d) inserting cover front flap 44 into cover front flap engagement structure (i.e., slot) 46 and closing the cover onto the carton.

There are at least four variations to this basic folding method.

The first variation involves creating a carton from pizza box blank 50 of FIG. 3, which has rear corner flaps 52 appended to a rear end of side walls 32. Blank 50 is the same as blank 30 except for the inclusion of the rear corner flaps. The folding method is the same as for blank 30 except it involves folding rear corner flaps 52 to an inward position during step (a).

The second variation involves creating a carton from pizza box blank 60 of FIG. 4, which has front corner flaps 62 appended to a front end of side walls 32. Blank 60 is the same as blank 30 except for the inclusion of the front corner flaps. The folding method is the same as for blank 30 except it involves folding front corner flaps 62 to an inward position prior to folding front wall 40 upright.

The third variation involves creating a carton from a pizza box blank of the general type shown in FIG. 2 of Orchard U.S. Pat. No. 4,265,393 granted May 5, 1981. The Orchard blank is generally similar to blank 30 except that it lacks cover front flap 44 and, instead, has a pair of narrow cover side flaps (indicated by numeral 15 in the Orchard patent). The folding method involves folding the cover side flaps exterior and parallel to the side walls and inserting the end of the flaps into slots in the bottom of the side walls. As a result, the cover side flaps are disposed in a locking engagement with the side walls. This folding method is popular in the Chicago pizza market and the blank used with the method is sometimes referred to as the "Chicago folder."

The fourth variation involves creating a non-wall-engaged carton from a pizza box blank of the general type shown in FIG. 1 of Correll U.S. Pat. No. 5,752,651 granted May 19, 1998. This Correll blank is generally similar to blank 60 (FIG. 4) except that the top edges of the side walls are free edges (i.e., the side walls lack top flaps appending from the top edge). The folding method involves folding the side walls upright but, since there are no top flaps, it lacks the sub-step of folding the top flaps inward.

Each of the above-cited pizza box blanks and associated packaging and transporting method results in a drawback. As regards the standard pizza carton with the double-panel front wall, it has engaged walls. To some pizza companies this is a drawback because it makes it difficult to use a rocker knife for cutting pizza in the box. (A rocker knife is the half-moon shaped pizza-cutting tool that cuts through a pizza by the motion of "rocking" the knife from one end of the knife to the other.)

Each of the five non-wall-engaged rectangular pizza cartons described above result in a carton having no interior-disposed support-bearing cover side flaps (the cover side flaps in the Orchard carton are exterior-disposed and also are too narrow to be significantly support-bearing). As a result, these cartons lack in stacking strength, or crush resistance, relative to the standard wall-engaged pizza carton.

Other non-wall-engaged cartons and associated folding methods found in the prior art include Blandford U.S. Pat. No. 1,530,644 granted Mar. 24, 1925; Hambleton U.S. Pat. No. 4,009,821 granted Mar. 1, 1977; Zion et al. U.S. Pat. No. 4,765,534 granted Aug. 23, 1988; Hall U.S. Pat. No. 4,804,136 granted Feb. 14, 1989; Keefe et al. U.S. Pat. No. 4,809,908 granted Mar. 7, 1989; Deiger U.S. Pat. No. 4,919,326 granted Apr. 24, 1990; Deiger U.S. Pat. No. 5,000,374 granted Mar. 19, 1991; Philips U.S. Pat. No. 5,110,039 granted May 5, 1992; Philips et al. U.S. Pat. No. 5,702,054 granted Dec. 30, 1997; Vinciguerra foreign patent 2804211 granted August, 1979; and Kenesu Japanese Patent 3-85244 granted April, 1991.

Blandford discloses a garment box. Because of the box's unconventional structure, the folding method disclosed by Blandford for erecting the blank into a carton is awkward and time-consuming and, thereby, deserves particular description. Blandford's folding method involves the steps of: (a) folding left and right side walls (12) to upright position and front and rear corner flaps (13) to an inward position, (b) folding front wall (10) to upright position, (c) folding ancillary panel (14) perpendicular to the front wall and folding end flaps (15) inward so that when the ancillary panel is carried over the top of the front corner flaps the end flaps are placed in vertical position at the inner sides of the side walls, whereby the front wall structure is now in an erected disposition, (d) pushing "movable heads" (31) in the side walls inward, (e) folding rear wall (11) and cover panel (16) to upright position, (f) folding cover side flaps (17) to an inward position and then depressing "keepers" (28) on the cover side flaps, (g) folding the cover panel downward and the cover side flaps to a position interior to the side walls and closing the cover on the carton, and (h) inserting a tongue (22) on the ancillary panel into a slot (20) in the cover panel. As the cover panel is being closed, the movable tabs in the side walls supposedly slide into the openings in the cover side flaps (the openings being created from depressing the "keepers"). It is important to note that with this folding method the front wall structure of the carton is erected prior to moving the left and right cover side flaps to a position interior to the side walls. Further, it is important to note that the Blandford blank/box lacks a hingedly movable cover front flap attached at a fold line to the front edge of the cover panel. Finally, it is important to note that the cover side flaps are disposed in a locking engagement with the side walls due to the insertion of the movable tabs (within the side walls) into the openings in the cover side flaps.

The Blandford blank and method results in a non-wall-engaged garment box. The box has interior-disposed cover side flaps disposed in locking engagement with the side walls, which make the carton inconvenient to open. Finally, the steps involved in creating the box are numerous, complicated, awkward, and time-consuming. In short, both the blank and the associated folding method are inconvenient and impractical for use in packaging a pizza.

After a pizza box blank has been erected into a carton, the resulting carton is typically placed in a stack with other cartons.

Subsequently, the carton is extracted from the stack and opened up, whereby an opened carton is created, also called a pre-folded carton in opened disposition.

Then a pizza is placed into the opened carton. This pizza can be either in a cut state or in an uncut state. To create the cut state, the pizza is cut out of the box prior to loading, known as out-of-box cutting. This operation typically occurs on a pizza peel or a board. After the cutting is performed, the cut pizza is slid from the peel or board into the opened carton. This procedure typically carries three drawbacks: (1) it creates a messy peel or board that needs constant wiping off, (2) if the carton is a wall-engaged carton, it results in slice separation of the pizza, which occurs during the transfer of the pizza from the peel into the carton, and (3) the transfer process consumes extra time.

If the pizza is placed into the carton in an uncut state, the pizza must subsequently be cut in the carton, known as in-box pizza-cutting. Typically one of two implements is used for this: Either (1) a rocker knife or (2) a pizza wheel. The type of cutting procedure used depends on the type of box: Non-wall-engaged or wall-engaged. With a non-wall-engaged carton, the pizza is positioned in the center of the bottom panel and then cut. This can be easily accomplished with either a rocker knife or a pizza wheel without damaging the carton because the walls of a non-wall-engaged carton can lay back to a horizontal disposition as the pizza is being cut. However, with a wall-engaged-carton the pizza must be positioned on the bottom panel several inches rearward of center, thereby enabling the rocker knife or pizza wheel to clear the erect front wall of the carton. After the cutting, the pizza is then slid forward with a jerk of the carton to position it in the center of the bottom panel, often resulting in slice separation. In addition, during the cutting operation in a wall-engaged carton, there's a tendency for the cutting implement to bend the left and right side walls of the carton to an outward-bending disposition, resulting in a sloppy-looking carton.

After the above placing (loading-cutting) operation, the opened box is closed up, or folded into a closed loaded carton. For some types of cartons this closing procedure can be time-consuming. For others it can be relatively fast. The speed of the closure operation is determined by (a) the structure of the carton and (b) the particular closing method that's employed.

Finally, the carton loaded with pizza undergoes transport from the pizzeria to a remote location such as a customer's residence. During this operation, steam from the pizza impregnates the carton and, thereby, reduces its crush-resistance. Further, oftentimes other loaded cartons are placed on top of the carton during transport. This can result in eventual side wall displacement or buckling which, in turn, can result in damage to the pizza. A particular rectangular carton's degree of crush-resistance relates, to a large extent, to two structural aspects of the carton: (1) the existence of a corner flap at each of the four corners of the carton and (2) the existence of support-bearing cover side flaps. A "support-bearing cover flap" is a cover flap that extends from the cover panel to the bottom panel in the closed carton.

In conclusion, inherent in the prior art methods of packaging and transporting pizza in a rectangular carton is a problem. Specifically, the problem is that every prior art method carries with it one or more of the following four drawbacks: (a) the blank is awkward and/or time-consuming to fold into a carton, (b) the ready-to-load carton does not allow unencumbered in-box pizza-cutting with a rocker knife or pizza wheel (due to the carton being in wall-engaged mode), (c) the ready-to-load carton is slightly awkward for sliding a pre-cut pizza into (due to the carton being in wall-engaged mode), and/or (d) the carton lacks left and right interior-disposed support-bearing cover side flaps and also left and right front corner flaps and left and right rear corner flaps and, thereby, the carton does not provide a level of stacking strength, or crush-resistance, comparable to that of the traditional rectangular wall-engaged pizza box (examples of the box blank for this type carton is shown in FIGS. 2–4; a blank for the traditional rectangular wall-engaged pizza box is shown in FIG. 1).

So, there is a need for a method of packaging and transporting pizza wherein the above-described problem is overcome. This need has not been satisfied by the prior art methods of packaging and transporting pizza, but is satisfied by my invention. By answering this need, a method of packaging and transporting pizza for improved efficiency and crush-resistance is provided.

SUMMARY OF THE INVENTION

My invention is a method wherein pizza can be packaged and transported for improved efficiency and crush-resistance, this method involving one or more of the following steps:

(1) providing a box blank cut and scored into a set of components erectable into a non-wall-engaged rectangular carton having interior-disposed support-bearing cover side flaps and comprising a substantially rectangular bottom panel having a predetermined front-to-rear length, a rear wall, opposing left and right side wall structures comprising respective left and right side walls each having a bottom edge length approximately equal to the predetermined front-to-rear length of the bottom panel and having a free top edge and free-swinging front and rear corner flaps attached to respective front and rear ends of the side wall, a front wall structure opposing the rear wall and comprising a front wall, an ancillary panel hingedly linked to a top edge of the front wall, and a cover front flap engagement structure, and a cover comprising a cover panel hingedly attached to the rear wall and a plurality of cover flaps comprising support-bearing left and right cover side flaps hingedly attached to respective left and right sides of the cover panel and a hingedly movable cover front flap attached at a fold line to a front edge of the cover panel;

(2) erecting the box blank into the non-wall-engaged rectangular carton by the sub-steps of:

(a) folding the box blank into a partially-erected carton wherein (i) the rear wall and the left and right side walls are each disposed in an upright position, (ii) the cover panel overlies the rear corner flaps, whereby the side walls are maintained in said upright position, (iii) at least a portion of each of the left and right cover side flaps is disposed interior to the left and right side walls, whereby the cover side flaps are maintained in a tucked-in position due to the upright position of the side walls, and (iv) the front wall structure is disposed in a non-erected position, and (b) subsequent to performing sub-step (a), folding the partially-erected carton into a fully-erected carton wherein (i) the left and right cover side flaps are disposed interior to the left and right side walls, (ii) the cover panel is in a substantially closed disposition, (iii) the front wall is in a substantially erected position, and (iv) the ancillary panel overlies the front corner flaps and is disposed substantially parallel to the bottom panel;

(3) opening the fully-erected carton into an opened carton or, in other words, providing a pre-folded non-wall-engaged rectangular carton in opened disposition, this carton comprising the set of components contained in the carton described in step 1 wherein each component of the set of components is disposed in a non-erected position;

(4) placing a pizza into the pre-folded non-wall-engaged rectangular carton in opened disposition and (optionally) cutting the pizza with a rocker knife;

(5) closing the pre-folded non-wall-engaged rectangular carton in opened disposition into a closed non-wall-engaged rectangular carton loaded with pizza and having interior-disposed support-bearing cover side flaps, this closing being performed by the sub-steps of:

(a) folding the pre-folded non-wall-engaged rectangular carton into a partially-erected carton wherein (i) the rear wall and the left and right side walls are each disposed in an upright position, (ii) the cover panel overlies the rear corner flaps, whereby the side walls are maintained in the upright position, (iii) at least a portion of each of the left and right cover side flaps is disposed interior to the left and right side walls, whereby the cover side flaps are maintained in a tucked-in position due to the upright position of the side walls, and (iv) the front wall structure is disposed in a non-erected position, and (b) subsequent to performing sub-step (a), folding the partially-erected carton into a fully-erected carton wherein (i) the left and right cover side flaps are disposed interior to the left and right side walls, (ii) the cover panel is in a substantially closed disposition, and (iii) the front wall and ancillary panel are in a substantially erected position; and (6) transporting the closed non-wall-engaged rectangular carton loaded with pizza.

A complete understanding of further aspects of the invention can be obtained from the detailed description that follows.

OBJECTS AND ADVANTAGES

A primary object of my invention is to provide a method wherein pizza can be packaged and transported with a combination of improved efficiency during box blank erection and carton closure and also improved product protection, or crush-resistance, during transport. A secondary object of my invention is to provide a particular process for efficiently erecting a particular type of box blank into a rectangular carton.

An overriding advantage of my invention is a particular superior result in the art of pizza packaging and transporting methods. This particular superior result derives from the achievement of a combination of three outcomes, this combination being heretofore unrealized with prior art pizza packaging and transporting methods involving rectangular pizza cartons. Specifically, the three outcomes are: (a) a box blank structure that allows for quick, easy erecting of the blank into a carton, (b) an opportunity for easy, unencumbered in-box pizza-cutting with a rocker knife and pizza wheel, and (c) transport of pizza in a carton that has a level of stacking strength, or crush resistance, closely comparable to that of the traditional wall-engaged rectangular pizza box (the blank of which is depicted in FIG. 1). Each of these outcomes exists individually in prior art pizza packaging and transporting methods involving rectangular cartons, but not until my invention have they existed in combination. It is this combination of the above-described three advantageous outcomes that constitutes an overriding advantage, or unexpected superior result, of my invention.

Further objects and advantages of the invention will become apparent from consideration of the following detailed description, related drawings, and appended claims.

BRIEF DESCRIPTION OF THE DRAWINGS

FIG. 6 is a perspective view of a partially-erected carton created from the preferred blank after a first stage of folding.

FIG. 7 is a perspective view of the partially-erected carton after a further stage of folding.

FIG. 9 is a perspective view of a closed carton with the cover front flap tucked in.

FIG. 10 is a side sectional view of the closed carton, taken along line 10—10 of FIG. 8.

FIG. 11 is a side sectional view of the closed carton, taken along line 11—11 of FIG. 8.

FIG. 12 is a top view of the left front corner section of the closed carton, with the cover panel being partially cut away.

LIST OF REFERENCE NUMERALS

Figure 2:
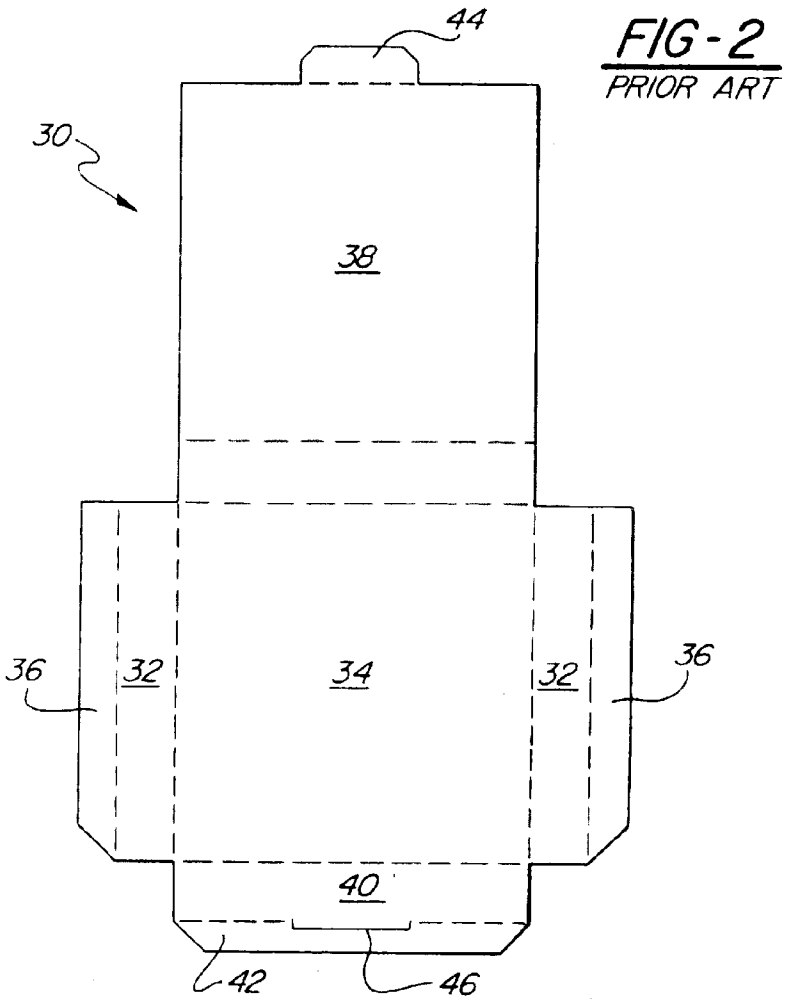
FIG-2 PRIOR ART
FIG. 2 is a plan view of a prior art box blank.
Figure 1:
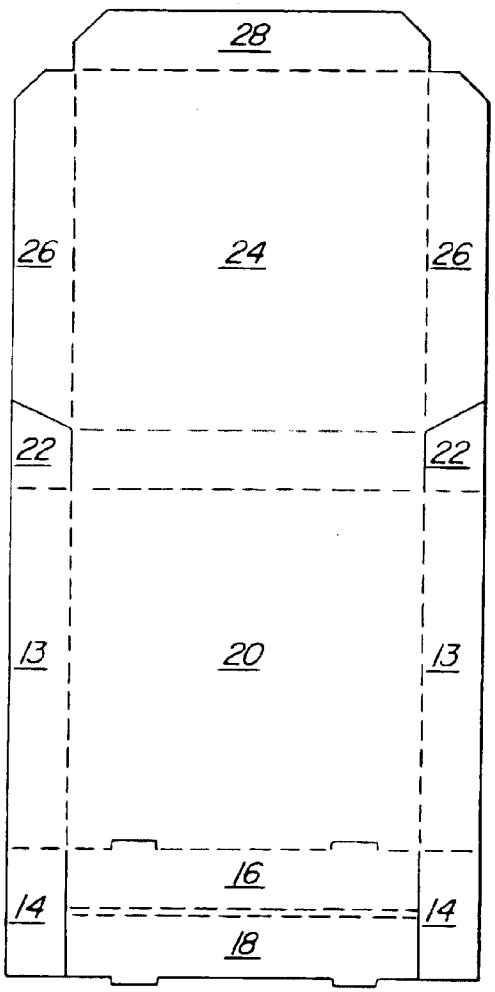
FIG-1 PRIOR ART
FIG. 1 is a plan view of a prior art box blank.
Figure 4:
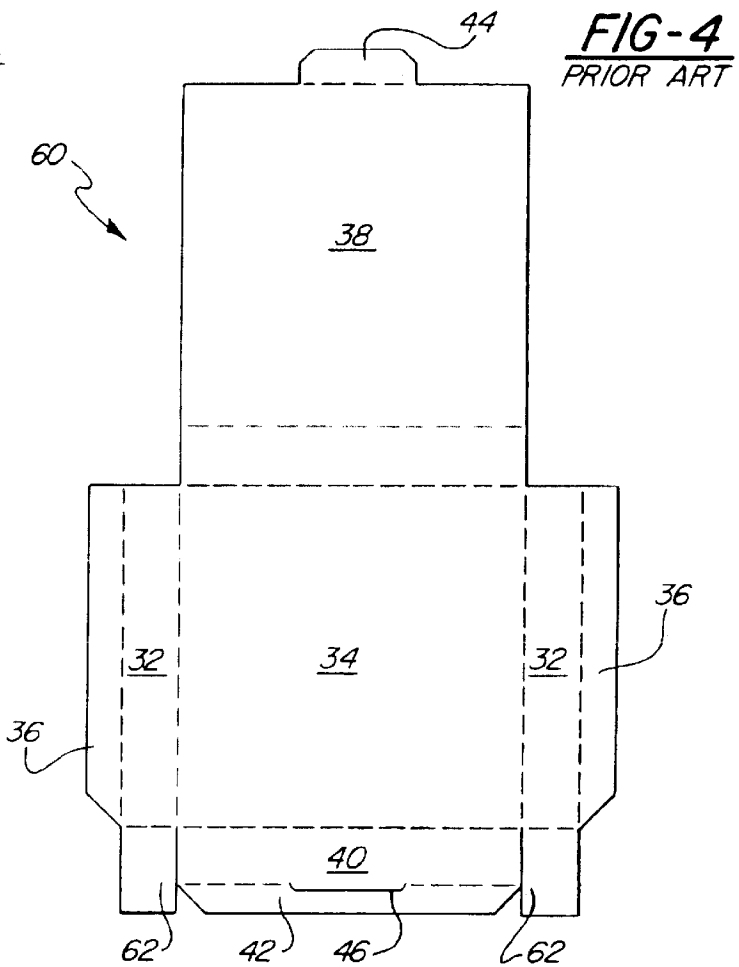
FIG-4 PRIOR ART
FIG. 4 is a plan view of a prior art box blank.

Within a drawing, closely related components have the same number. Between drawings, like reference numerals designate corresponding parts.

12 blank of a prior art box
13 side wall
14 front corner flap
16 outer panel (front wall)
18 inner panel (ancillary panel)
20 bottom panel
22 rear corner flap
24 cover panel
26 cover side flap
28 cover front flap
30 blank of a prior art box
32 side wall
34 bottom panel
36 top flap on side wall (side top flap)
38 cover panel
40 front wall
42 ancillary panel (front top flap)
44 cover front flap
46 cover front flap engagement structure
50 blank of a prior art box
52 rear corner flap
60 blank of a prior art box
62 front corner flap
70 preferred embodiment of box blank for use with the method
72 bottom panel
74 front-to-back length of bottom panel
76 left-to-right width of bottom panel
82 rear wall
84 bottom edge of rear wall
90 front wall structure
92 front wall
94 bottom edge of front wall
96 ancillary panel
96*a* first portion of alternate ancillary panel
96*b* second portion of alternate ancillary panel
97 free end edge of ancillary panel
98 cover front flap engagement structure
100 side wall structure
102 side wall
103 free top edge of side wall
104 bottom edge of side wall
106 front corner flap
107 top edge of corner flap
108 rear corner flap
110 cover structure
112 cover panel
114 rear edge of cover panel
116 cover side flap
118 bottom edge of cover side flap
119 recessed portion
120 cover front flap
121 fold line
122 left-to-right width of cover front flap
132 partially-erected carton
134 partially-erected carton
136 fully-erected carton
138 fully-erected carton
140 blank of alternate version
142 carton of alternate version
144 obtuse angle
145 acute angle
146 obtuse-angle-stabilizing tab
150 opened non-wall-engaged carton
152 optional fold line in ancillary panel

DESCRIPTION OF A PREFERRED EMBODIMENT OF THE CARTON

The inventive method involves use of a particular type of box blank for packaging pizza in a particular non-wall-engaged rectangular pizza carton. Referring now to the drawings, there is illustrated a preferred embodiment of that blank in the format of a one-piece blank 70 made of corrugated paperboard.

Figure 5:
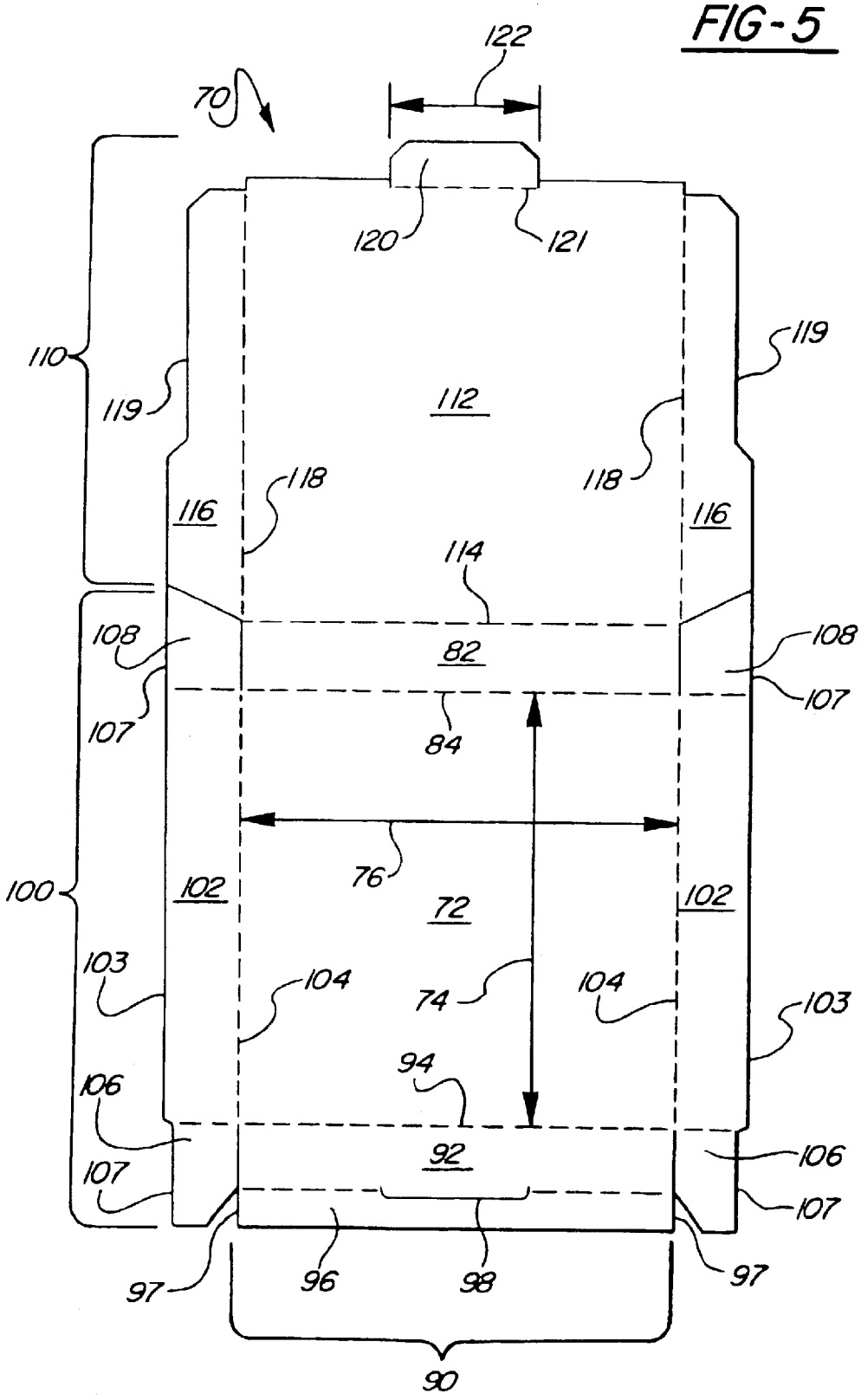
FIG. 5 is a plan view of a preferred embodiment of the type of pizza box blank recommended for the method.
Figure 8:
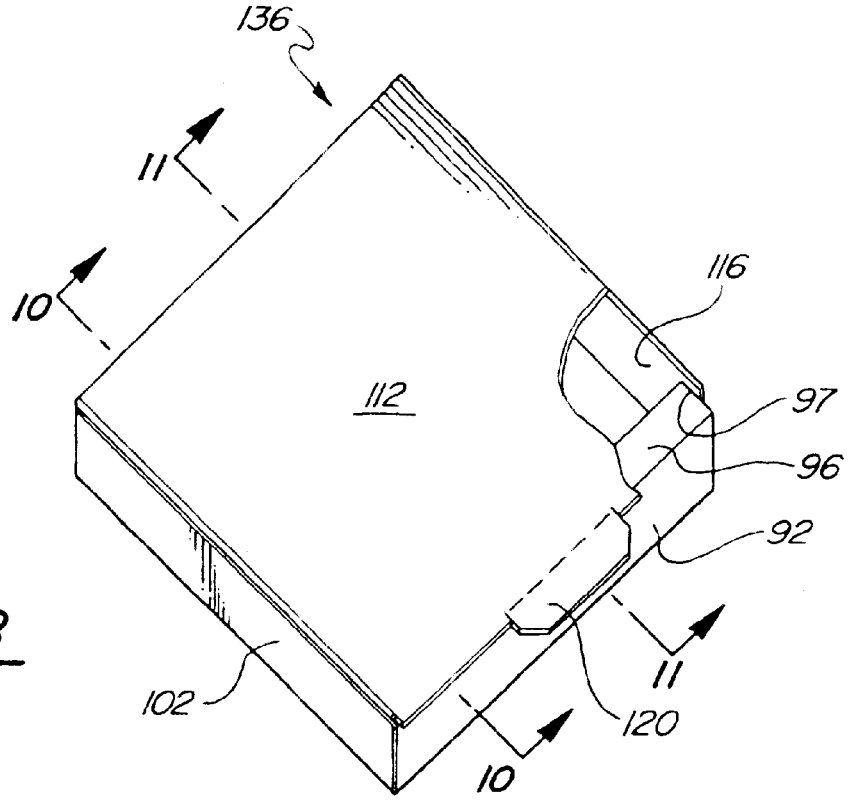
FIG. 8 is a perspective view of a closed ready-to-load carton with the cover front flap outside.
Figure 9:
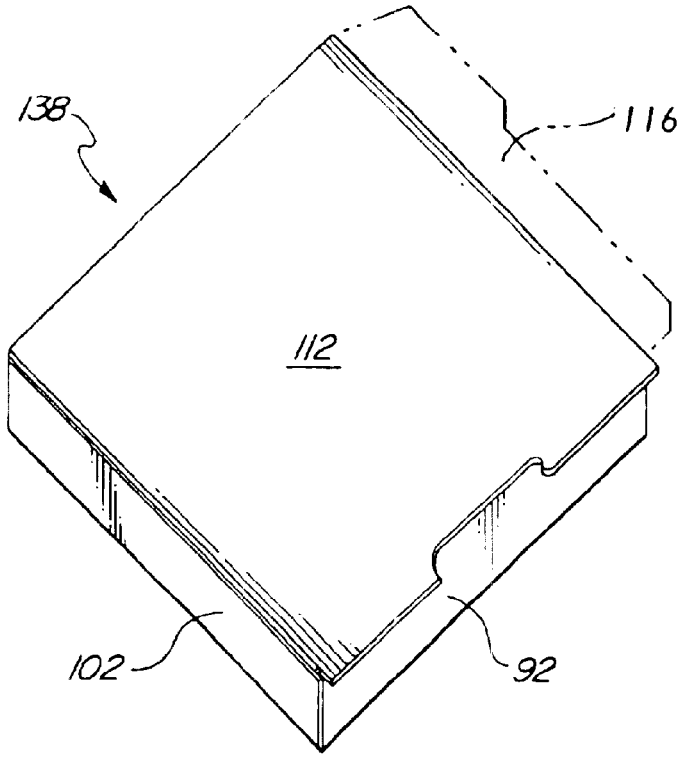

FIG. 5 shows pizza box blank 70 and FIGS. 6 through 9 show partially-erected and fully-erected versions of a pizza carton created from blank 70. Referenced components are labeled in FIG. 5; selected components are labeled in other Figures. Corresponding parts between drawings share a same reference numeral. It is noted that the invention is bilaterally symmetrical. Therefore, pairs of opposing like components are to be found, with one item of the pair on each side of the blank or carton. For simplicity of labeling, each component of the opposing pair will have the same reference numeral. Also, a pair may be indicated by a numeral on one side of the drawing only. Where this occurs it is to be understood that the discussion also applies to the corresponding component on the other side, even though that component may not be numerically labeled.

The embodiment has a substantially square, or rectangular, bottom panel 72 which has a front-to-rear length 74 and a left-to-right width 76.

A rear wall 82 is hingedly attached at a bottom edge 84 to bottom panel 72. The length of bottom edge 84 is approximately equal to left-to-right width 76.

The embodiment also has a front wall structure 90 comprising a front wall 92 hingedly attached to bottom panel 72 at a bottom edge 94, an ancillary panel 96 hingedly attached to a top edge of wall 92 at a fold line, and a cover front flap engagement structure 98. Ancillary panel 96 has opposing free end edges 97 (meaning, the end edges are free of attachment to any other panel or flap). The length of bottom edge 94 is approximately equal to left-to-right width 76. And the left-to-right width of ancillary panel 96 is also approximately equal to left-to-right width 76.

In the embodiment, cover front flap engagement structure 98 is a U-shaped slot-forming slit disposed adjacent the top edge of front wall 92, or between front wall 92 and ancillary panel 96. When panel 96 is moved perpendicular to wall 92, the slot-forming slit opens up into a narrow slot capable of receiving and holding a cover front flap. Engagement structure 98 could also take other forms known to those skilled in the art. For example it could be a knock-out slot. It also could be a pair of tabs projecting from the top edge of the front wall structure and which are disposed at the ends of the cover front flap in the carton. An example of that structure is shown in my U.S. Pat. No. 6,290,122 (Versatile Pizza Carton). In the claims, engagement structure 98 also could be referred to as a cover front flap engagement slot.

Further, the embodiment has a pair of opposing left and right side wall structures 100. Each structure comprises a side wall 102 hingedly attached to bottom panel 72 at a bottom edge 104, a front corner flap 106 hingedly attached to a front end of the side wall, and a rear corner flap 108 hingedly attached to a rear end. The length of bottom edge 104 is approximately equal to front-to-rear length 74. Each side wall 102 has a free top edge 103 (meaning there are no flaps or panels attached to it). Corner flaps 106 and 108 are free-swinging flaps, meaning that each flap is free of attachment to any other flap or panel (other than the side wall) after the blank has been erected into a carton. Also, in the carton the corner flaps are free of locking engagement with any other panel. Further, each corner flap has a top edge 107. It is noted that top edge 107 in each front corner flap 106 is disposed slightly lower than free top edge 103. The purpose of this is to enable front wall 92 to be of a height that results in a carton that "sits level" on a table or, in other words, has a front end height that's the same as the rear end height. The benefit of this condition is that it allows for a straight, or non-leaning, stack when multiple cartons are stacked.

Finally, the embodiment has a cover structure 110 comprising a cover panel 112 hingedly attached to a top edge of rear wall 82 at a cover rear edge 114, a pair of opposing left and right cover side flaps 116 each hingedly attached to cover panel 112 at a bottom edge 118, and a hingedly movable cover front flap 120 attached at a fold line 121 to a front edge of the cover panel. The length of bottom edge 118 is approximately equal to front-to-rear length 74. In the embodiment the length of bottom edge 118 happens to be the length of the cover side flap, so the length of the side flap is approximately equal to front-to-rear length 74. Further, each cover side flap 116 has a recessed portion 119 disposed along an outer edge. It is noted that the recessed portion extends all the way to a front end of the cover side flap. Further, it is noted that, in the carton, the cover side flaps are free of locking engagement with side walls 102. This configuration differs from that of certain prior art non-wall-engaged rectangular cartons having cover side flaps which are disposed in locking engagement with the side walls (i.e., Blandford U.S. Pat. No. 1,530,644 and Orchard U.S. Pat. No. 4,265,393).

In addition, it is noted that cover side flaps 116 are interior-disposed support-bearing cover side flaps; meaning that, when the carton is in a fully-erected format (see FIGS. 8, 9), the cover side flaps are disposed on the interior side of side walls 102 and also assist in supporting or maintaining the horizontal rigidity of cover panel 112 or, in other words, reduce the tendency for cover panel 112 to buckle, or cave in, from a load placed on top of it. Lastly, cover front flap 120 has a left-to-right width 122, which happens to be substantially shorter than left-to-right width 76 and bottom edge 94 of the front wall.

An Alternate Version of the Preferred Embodiment of the Box Blank and Carton

Figure 13:
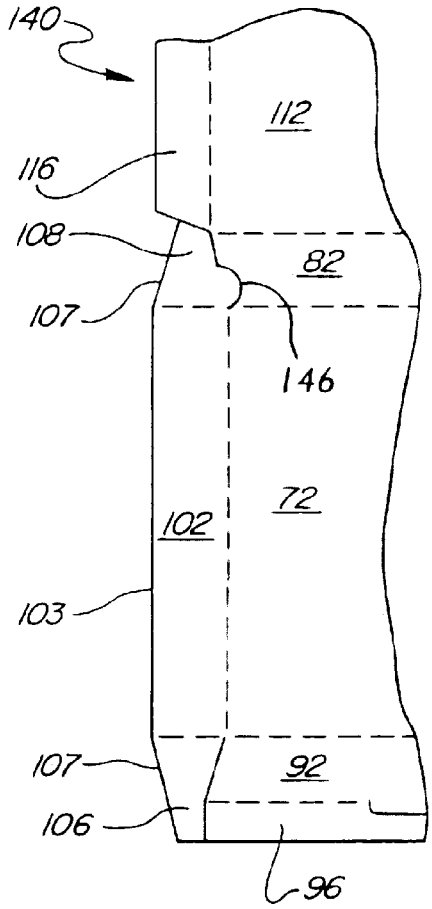
FIG. 13 is a plan view of a front corner section of an alternate version of box blank.
Figure 14:
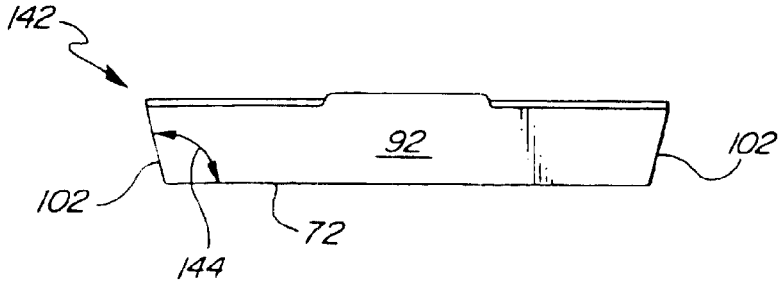
FIG. 14 is a front elevation view of a carton erected from the alternate version of box blank.

An alternate version of the preferred embodiment of box blank and carton can be created by making top edge 107 of each of corner flaps 106/108 slope downward from top edge 103. This variation is depicted in a sectional view of a blank 140, which essentially is blank 70 with modifications as shown in FIG. 13. A front elevation view of a carton 142 created from blank 140 is shown in FIG. 14. As can be seen, side walls 102 are disposed at an obtuse angle 144 to bottom panel 72. This structure is also shown in my U.S. Pat. No. 6,065,669 (Slanting-wall Pizza Box). In addition to downward-sloping top edge 107, rear corner flaps 108 also have an obtuse-angle-stabilizing tab 146 projecting from a bottom edge of the flap. This serves to position side wall 102 at the proper obtuse angle when blank 140 is being folded into carton 142. Lastly, it is pointed out that in carton 140 front wall 92 and rear wall 82 are disposed perpendicular to bottom panel 72, as they are in carton 136/138.

Definition of Key Terms

In describing the invention several key terms are applied. As used herein, here's how those terms are specifically defined.

"Wall-engaged mode" is a disposition in which a carton has at least two wall structures engaged one to the other, such that when the cover of the carton is in opened disposition those two wall structures remain in an erected position. A carton in wall-engaged mode may be called a "wall-engaged carton."

"Non-wall-engaged mode" is a disposition in which none of the wall structures of a carton are engaged one to another. A carton in non-wall-engaged mode may be called a "non-wall-engaged carton." It is noted that mere contact or abutment of one panel with another does not constitute an engagement of the panels.

Figure 16:
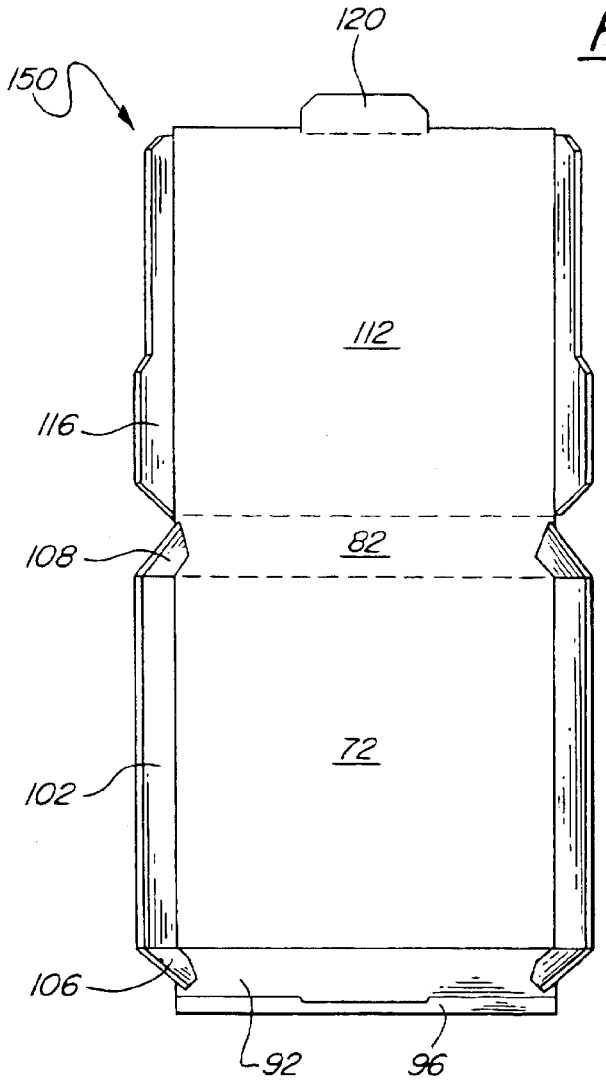
FIG. 16 is a top view of the preferred carton in opened disposition.

An "opened carton" is a carton that has the cover panel in an opened (or non-closed) disposition. An "opened non-wall-engaged carton" is a carton that has the cover panel in opened disposition and in which none of the wall structures of the carton are engaged to another wall structure. An opened carton may be called a "carton in opened disposition." An example is illustrated by carton 150 (FIG. 16). Carton 150 may also be called a "pre-folded carton in opened disposition."

An opened carton is not to be confused with a box blank. A "box blank" is a substantially flat sheet of material that has been cut and scored into a set of component panels capable of being erected into a carton. A box blank has not yet been folded or erected into a carton (either a fully-erected carton or a partially-erected carton). As such, all of the component panels are disposed substantially coplanar to each other. By comparison, in a carton, at least two of the component panels are disposed non-coplanar to each other.

A "closed carton" is a carton that has the cover panel in a substantially closed disposition. To have a closed disposition it's not necessary that all of the cover flaps be disposed inside the holding cavity of the carton. Cartons 136/138 are examples of a closed carton. A closed carton can be either non-loaded (i.e., ready-to-load) or loaded with product.

A "fully-erected carton" is a carton in which all of the wall structures are in a substantially erected position and the cover panel is in a substantially closed disposition.

A "partially-erected carton" is a carton in which at least one of the wall structures is in a substantially erected position and at least one of the wall structures is in a non-erected position.

A "ready-to-load carton" is either a partially-erected carton or a fully-erected carton that does not yet contain a pizza. Most pizzerias pre-fold box blanks into ready-to-load cartons prior to the pizza orders being taken. These empty, or non-loaded, cartons are typically stored in stacks around the pizzeria until such time as they're extracted from the stack and loaded with pizza. A ready-to-load carton can be in either open or closed disposition. If it's a closed carton then, of course, the cover must be opened prior to loading a pizza.

An "erected position" of a particular panel or structure of a carton is the position that that panel or structure assumes when the carton is in a fully-erected disposition. As applied to front wall structure 90 of the preferred embodiment, for example, that structure would be in an erected position when front wall 92 is in an upright position and ancillary panel 96 is overlying front corner flaps 106 and is disposed substantially parallel to bottom panel 72.

A "non-erected position" of a particular panel or structure of a carton is any position other than an erected, or substantially erected, position.

A "cover front flap engagement structure" is any structure that's part of the front wall structure and that engages a front flap appending from a cover panel when the carton is in an erected disposition. A common configuration of cover front flap engagement structure is a slit or slot in the front wall structure. Another configuration of engagement structure is a pair of tabs projecting inwardly from the top edge of the front wall structure.

A "closed-carton maintenance condition" is any contact or engagement between two or more panels or structures of a closed, erected non-wall-engaged carton that act to maintain the carton in its closed, erected disposition.

A "free-swinging corner flap" is a corner flap that is hingedly attached to a wall panel and is free of attachment to any other flap or panel (other than the wall panel) after the blank has been folded into a carton, or when the carton is in erected disposition.

An "interior-disposed cover side flap" is a flap appended to a side edge of a cover panel of a carton and disposed on an interior side of a side wall of the carton. It is noted that it's possible for a small portion of cover side flaps 116 to be disposed higher than the top edge of side walls 102. However, as long as the cover side flaps are disposed interior to the plane of the side walls the cover side flaps are considered to be disposed interior to the side walls. A "support-bearing cover flap" is a cover flap that extends from the cover panel to the bottom panel when the carton is in a closed disposition. So an "interior-disposed support-bearing cover side flap" is an interior-disposed cover side flap that extends from the cover panel to the bottom panel when the carton is in closed disposition.

A "free edge" is an edge of a panel or flap that is not attached to any other panel or flap.

A "locking engagement" exists between two panels when the panels are interconnected to each other. A typical form of locking engagement occurs when a portion of a first panel is disposed within a slot, groove, or opening in a second panel. For example, when cover front flap 120 is disposed within cover front flap engagement slot 98 a locking engagement exists between cover structure 110 and front wall structure 90. It is noted that a mere frictional contact between abutting or facing panels does not constitute a locking engagement. Also, two panels hingedly connected at a fold line does not constitute a locking engagement.

A "pizza box blank" is a box blank that ultimately will be folded, or erected, into a pizza carton, or that is produced with the intention of being used in packaging pizza.

A "pizza carton" is a carton that is used, or will be used, for holding pizza.

Within the drawing of the blank, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. In short, as referred to herein, a fold line is any line between two points on the blank or carton along which the board is intended to be folded when the blank is being erected into a carton or when the carton is being manipulated according to the method described herein. The type of fold lines shown in the drawings are presently preferred but it will be appreciated that other methods known to those skilled in the art may be used.

DESCRIPTION OF THE PREFERRED EMBODIMENT OF THE METHOD

This invention involves a method of packaging and transporting pizza. The essence of the preferred embodiment of the method involves packaging and transporting the pizza in a pizza carton having the general configuration or components depicted in box blank 70 (FIG. 5) and the resulting carton 136/138. When divided into procedural components, the general method comprises the following procedural steps, which first will be listed in brief; then described in detail.

The preferred embodiment of the method includes the following six steps:

(a) Providing a pizza box blank of a configuration similar to that of box blank 70;

(b) Erecting the box blank into a non-wall-engaged rectangular pizza carton using a folding method comprising the sub-steps of (i) folding the blank into a partially-erected carton having a non-erected front wall structure and (ii) folding the partially-erected carton into a fully-erected carton (after which the carton will likely be incorporated into a stack of similar cartons);

(c) Opening the ready-to-load carton, whereby a non-wall-engaged rectangular pizza carton in opened disposition is provided, otherwise called an opened non-wall-engaged rectangular pizza carton;

(d) Placing a pizza into the opened carton and (optionally) cutting the pizza with a rocker knife;

(e) Closing the opened carton into a closed loaded rectangular pizza carton using a folding method comprising the sub-steps of (i) folding the opened carton into a partially-erected carton having a non-erected front wall structure and (ii) folding the partially-erected carton into a fully-erected carton; and (f) Transporting the pizza in the closed loaded rectangular pizza carton.

Now the steps will be further described in detail.

STEP A: Providing a pizza box blank of a configuration similar to that of blank 70 (FIG. 5). Such a blank would likely comprise the following components:

(1) a substantially rectangular bottom panel having a predetermined front-to-rear length and a predetermined left-to-right width;

(2) a rear wall hingedly attached to the bottom panel and having a predetermined bottom edge length approximately equal to the predetermined left-to-right width of the bottom panel;

(3) opposing left and right side wall structures comprising respective left and right side walls hingedly attached to the bottom panel, respective left and right free-swinging front corner flaps hingedly attached to a front end of the side walls, and respective left and right free-swinging rear corner flaps hingedly attached to a rear end of the side walls, each of the side walls having a free top edge and a predetermined bottom edge length approximately equal to the predetermined front-to-rear length of the bottom panel;

(4) a front wall structure opposing the rear wall and comprising a front wall hingedly attached to the bottom panel and an ancillary panel hingedly linked to a top edge of the front wall, the front wall having a predetermined bottom edge length approximately equal to the predetermined left-to-right width of the bottom panel; and (5) a cover structure comprising a cover panel hingedly attached to the rear wall, opposing left and right support-bearing cover side flaps hingedly attached to respective left and right sides of the cover panel, and a hingedly movable cover front flap attached to a front edge of the cover panel.

STEP B: Erecting the box blank into a non-wall-engaged rectangular pizza carton. The preferred way to do this is by a folding method comprising the sub-steps of (i) folding the blank into a partially-erected carton having a non-erected front wall structure and (ii) folding the partially-erected carton into a fully-erected carton. To fold blank 70 into a fully-erected carton (either carton 136 or 138), the following two-step procedure is recommended. It is noted that this procedure is disclosed in my U.S. Pat. No. 6,290,122 (Versatile Pizza Carton) and in my U.S. Pat. No. 6,065,669 (Slanting-wall Pizza Box). In the preferred embodiment of the method, the following two sub-steps are applied within step B.

SUB-STEP B1: Folding the blank into partially-erected carton 134 (FIG. 7), which has the following four key characteristics. First, rear wall 82 and left and right side walls 102 are disposed in an upright position. Second, cover panel 112 overlies left and right rear corner flaps 108, whereby the side walls are maintained in the upright position. Third, at least a portion of left and right cover side flaps 116 are disposed interior to the left and right sides walls, whereby the cover side flaps are maintained in a tucked-in position due to the upright position of the side walls. Fourth, front wall structure 90 is disposed in a non-erected position. (For illustrative purposes FIG. 7 shows carton 134 with the cover panel in a slightly open position. However, if the cover panel were fully closed the resulting partially-erected carton would still meet the above-described four key characteristics and, as a result, would satisfy the requirements of this sub-step B1.)

SUB-STEP B2: Folding partially-erected carton 134 into a fully-erected carton of the format of carton 136/138 (FIGS. 8, 9), which has the following four key characteristics. First, a least a majority portion of left and right cover side flaps 116 are disposed interior to left and right side walls 102. (In the preferred embodiment virtually the entire portion of cover side flaps is disposed interior to the side walls.) Second, cover panel 112 is in a substantially closed disposition. Third, front wall 92 is in a substantially upright or erected position. Fourth, ancillary panel 96 overlies left and right front corner flaps 106 and is disposed substantially parallel to the bottom panel and to the cover panel and is substantially perpendicular to the front wall. This configuration is depicted in FIG. 10, which shows a side sectional view of carton 136 (FIG. 8) taken along line 10—10.

After blank 70 is erected into a carton, the carton can assume either of two configurations. The first configuration has cover front flap 120 disposed outside of the holding cavity of the carton (the holding cavity being the inner space of the carton circumscribed by the four walls, cover panel, and bottom panel of the carton). The second configuration has the cover front flap disposed parallel to front wall 92 and within the holding cavity (or, specifically, disposed within cover front flap engagement structure 98, which in the embodiment is a slot in front wall structure 90). The first configuration results is carton 136 shown in FIG. 8. The second configuration results is carton 138 shown in FIG. 9.

Figure 3:
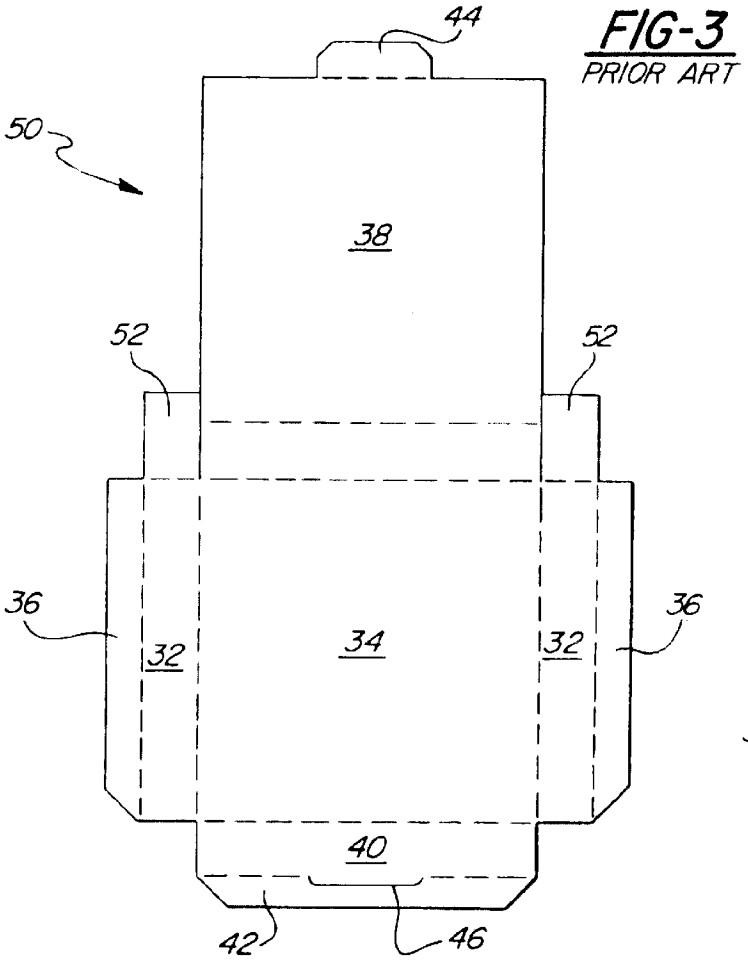
FIG-3 PRIOR ART
FIG. 3 is a plan view of a prior art box blank.

Each configuration of the carton is maintained in a closed disposition by means of a particular closed-carton maintenance condition. The closed-carton maintenance condition that exists in the first configuration (carton 136) is frictional contact between free end edges 97 and cover side flaps 116. FIG. 12 shows a cut-away portion of the left front corner of the closed carton (136/138) with end edge 97 in frictional contact with cover side flap 116. For illustrative clarity, the drawing shows a slight gap between the end edge and the cover side flap. In reality, however, there would be no such gap and those two surfaces would be in contact. This invention of using frictional contact between the free end of an ancillary panel and a cover side flap to maintain an erected, closed disposition of a non-wall-engaged carton is disclosed in my U.S. Pat. No. 6,290,122 (FIG. 3 in that patent).

The closed-carton maintenance condition that exists in the second configuration (carton 138) is the disposition of cover front flap 120 within the slot (or cover front flap engagement structure 98) of front wall structure 90. Carton 138 also can be configured into an optional variation in which one or both of cover side flaps 116 is disposed outside the holding cavity of the carton (illustrated with phantom lines in FIG. 9). It is noted that, in this optional configuration, cover side flap 116 is disposed approximately coplanar to cover panel 112, or non-parallel to side wall 102. A possible advantage of this configuration is that it provides an easy-to-grasp "handle" for extracting the box from a stack.

If the carton is going to be re-opened later for inserting product into it, folding the blank into the first configuration is recommended because it consumes less folding time than does folding the blank into the second configuration.

STEP C: Opening the ready-to-load carton, whereby an opened non-wall-engaged rectangular pizza carton 150 is provided. FIG. 16 shows what opened carton 150 might look like from a top view. This carton may also be referred to called a "pre-folded non-wall-engaged rectangular pizza carton in opened disposition." In this opened carton the walls are non-engaged and, thereby, are free to fall back when outward-pushing pressure is applied. This allows a pizza to be properly cut in the open carton using a rocker knife or pizza wheel without having to position the pizza rearward of center on the bottom panel. The structure of carton 150 is essentially that of blank 70, except the side and front wall panels likely will be disposed at an obtuse angle to the bottom panel (due to those panels having previously been in an erected disposition).

STEP D: Placing a pizza into the opened carton and cutting the pizza with a rocker knife or pizza wheel. In-box pizza-cutting is a recommended part of this step, but is not mandatory, as the pizza can be cut prior to placing it into the carton.

STEP E: Closing the opened carton into a closed loaded rectangular pizza carton. The preferred way to do this is by a folding method comprising the sub-steps of (i) folding the opened carton into a partially-erected carton having a non-erected front wall structure and (ii) folding the partially-erected carton into a fully-erected carton, whereby a loaded non-wall-engaged rectangular carton of the type made from blank 70 is formed (which would resemble carton 138, FIG. 9). Essentially, the two-step folding method recommended in Sub-steps B1/B2 for folding the blank into a non-loaded carton is also applied here to fold the opened loaded carton into a closed loaded carton.

STEP F: Transporting the pizza in the closed loaded rectangular pizza carton, this carton having the set of components of the box blank described in Step A.

A unique aspect of the preferred embodiment of the method is providing a pizza box blank that's capable of being erected into a carton disposed in the first configuration (carton 136) and which has the capacity of being opened and subsequently erected into a second configuration (carton 138), both configurations being in non-wall-engaged mode. Box blank 70 is a blank capable of performing that function.

For historical reference, a version of carton 136 is disclosed in my U.S. Pat. No. 6,290,122 (FIGS. 2–5) and a version of carton 138 is disclosed in my U.S. Pat. No. 6,065,669 (FIGS. 6 and 7).

CONSTRUCTION NOTE: If front wall 92 of carton 136 does not stay in upright or erected position (i.e., it springs outward after the cover is closed), box blank 70 must be re-configured so that, after the blank has been folded into a carton, there's tighter frictional contact between free end edges 97 of the ancillary panel and cover side flaps 116. This can be accomplished by slightly increasing the left-to-right width, or the distance between end edges 97, of ancillary panel 96.

Conversely, if closing the cover on carton 136 is overly difficult, it may be that the frictional contact between end edges 97 and cover side flaps 116 is too tight. In this case the width of ancillary panel 96, or distance between end edges 97, may need to be slightly decreased. In short, for proper functioning of the carton, the width of ancillary panel 96 in box blank 70 may have to be adjusted slightly from that shown in the drawings. One reason for this is differing thicknesses between various types of corrugated board.

Figure 15:
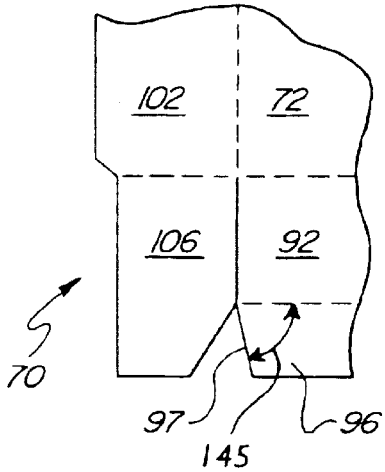
FIG. 15 is a plan view of a front corner section of the preferred box blank with an alternate end edge 97.

To assist with achieving the proper degree of frictional contact between end edges 97 and cover side flaps 116, it may help to configure end edge 97 at an acute angle to the top edge of front wall 92. This angle is shown as angle 145 in FIG. 15, which depicts a section of blank 70 with the alternate configuration of end edge 97.

Recommended Folding Procedure for Sub-Steps B1/B2

To perform sub-steps B1 and B2 in an expeditious manner, the following folding procedure is applied when folding blank 70 into a carton.

First, position the blank so that it's horizontal and with the inside surface up and front wall structure 90 next to the abdomen (i.e., with the outer edge of ancillary panel 96 braced against your abdomen).

Second, with your hands placed near the rear end of side walls 102, simultaneously fold side walls 102 inward and, with your index fingers, fold rear corner flaps 108 inward. At this point you have a partially-erected carton 132, shown in FIG. 6, with side walls 102 disposed non-coplanar to bottom panel 72 and rear corner flaps 108 disposed non-coplanar to the side walls.

Third, while keeping your hands in that position (i.e., at the rear end of side walls 102) and while holding the side walls upright, with your fingers pull rear wall 82 upright, or to a position non-coplanar to bottom panel 72.

Fourth, fold cover panel 112 downward to about halfway closed.

Fifth, fold cover side flaps 116 inward and position them interior to side walls 102 and then fold cover panel 112 all the way, or almost all the way, closed. At this point you have a partially-erected carton 134, shown in FIG. 7. In this disposition rear wall 82 and side walls 102 are disposed in upright position, cover panel 112 overlies rear corner flaps 108, thereby holding the side walls in upright position, and cover side flaps 116 are disposed interior to the side walls and maintained in a tucked-in position due to the upright position of the side walls. It is noted that front wall structure 90 is in a non-erected position (meaning, a position other than the position that the structure would assume when the carton is fully erected).

The above-described five steps apply to performing sub-step B1 and, thereby, can be regarded as sub-sub-steps of sub-step B1. The following three steps apply to performing sub-step B2 and, thereby, can be regarded as sub-sub-steps of sub-step B2.

Sixth, turn the partially-erected carton to a vertical position with front wall structure 90 up.

Seventh, open cover panel 112 about three inches and then fold both front corner flaps 106 inward.

Eighth, fold front wall 92 upright, or perpendicular to bottom panel 72, and fold ancillary panel 96 inward until it's perpendicular to front wall 92. Finally, move cover panel 112 into closed disposition. This step can sometimes be most easily executed with the rear end of the box held against a surface. This can be accomplished by either (a) holding the box vertically with the rear end resting on a table or (b) holding the box horizontally upside down with the rear end held against your abdomen.

A similar folding procedure to the above is applied when folding the opened carton into a closed loaded carton during STEP E, except that the carton remains in a horizontal position on a table top during the entire method.

An Alternate Ancillary Panel Structure and Closing Step

Figure 17:
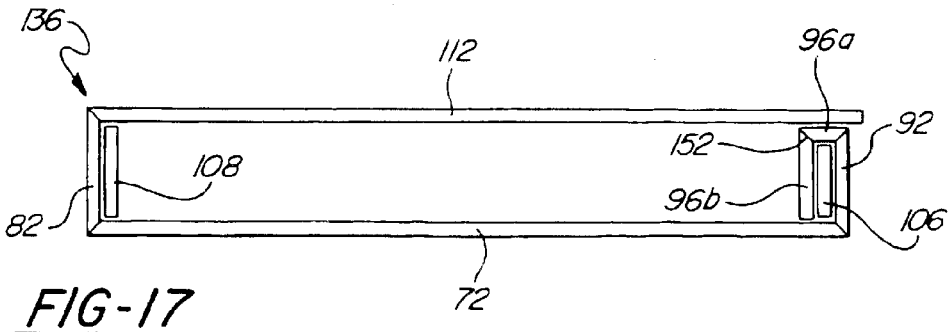
FIG. 17 is a side sectional view of a closed carton, taken along line 10—10 of FIG. 8, with an alternate ancillary panel in wall-engaged mode.

It's possible to configure ancillary panel 96 into two portions, **96*a* and 96*b*, joined at a fold line 152, so that portion 96***b* can be folded downward and approximately parallel to front wall 92 during the final closing STEP E. This arrangement is depicted in FIG. 17, which shows a side sectional view of a closed carton (taken along line 10—10 of FIG. 8) having the optional ancillary panel structure. To hold portion 96*b* in vertical position, either adequate frictional contact or a locking engagement between either the ancillary panel and the side walls or the ancillary panel and the bottom panel is required. The result of this arrangement is that side wall structures 100 are engaged with front wall structure 90 in the closed loaded carton, thereby putting the closed carton into a wall-engaged mode. This invention of converting a non-wall-engaged carton into a wall-engaged carton is disclosed in my U.S. Pat. No. 6,290,122 granted Sep. 18, 2001 (Versatile Pizza Carton).

So, by using this optional alternate approach, the inventive method enables opened non-wall-engaged carton 150 to be closed up into either a closed non-wall-engaged carton or a closed wall-engaged carton, whichever the operator chooses.

Finally, it's noted that it's possible to accomplish this by using the regular ancillary panel (i.e., the panel without optional fold line 152) simply by pushing ancillary panel 96 into a vertical position when closing the loaded carton (during the closing step). Although this approach can work it likely will not work as elegantly as when fold line 152 is included in the ancillary panel.

CONCLUSION, RAMIFICATIONS, AND SCOPE

I have disclosed an easy-to-apply method of packaging and transporting pizza for improved efficiency and crush-resistance.

A main advantage of my invention is that it enables pizzeria workers to easily apply in-box pizza-cutting using a rocker knife while having a carton that's easy to use and also provides stacking strength, or crush-resistance, comparable to that of the standard wall-engaged pizza box.

The illustrated pizza box blank represents the preferred embodiment of blank used with the method; however, other configurations of pizza box blank are possible within the scope of the invention. Two examples of such blanks and resulting cartons have been disclosed herein.

In conclusion, it is understood that the invention is not to be limited to the disclosed embodiments but, on the contrary, is intended to cover various applications, modifications, and equivalent arrangements included within the spirit and scope of the appended claims, which scope is to be accorded the broadest interpretation so as to encompass all such applications, modifications, and equivalent arrangements as is permitted under the law.

I claim:

1. A method of packaging pizza, said method comprising the steps of:

providing a pizza box blank cut and scored into a set of components erectable into a non-wall-engaged rectangular pizza carton having interior-disposed support-bearing cover side flaps and comprising:

a substantially rectangular bottom panel having a predetermined front-to-rear length, a rear wall, opposing left and right side wall structures comprising (i) respective left and right side walls each having a bottom edge length approximately equal to the predetermined front-to-rear length of said bottom panel and having a free top edge and (ii) free-swinging front and rear corner flaps attached to respective front and rear ends of the side walls, each of the corner flaps being free of locking engagement, a front wall structure opposing said rear wall and comprising (i) a front wall, (ii) an ancillary panel hingedly linked to a top edge of said front wall, and (iii) a cover front flap engagement structure, and a cover comprising (i) a cover panel hingedly attached to said rear wall and (ii) a plurality of cover flaps comprising support-bearing left and right cover side flaps hingedly attached to respective left and right sides of said cover panel and a hingedly movable cover front flap attached at a fold line to a front edge of said cover panel;

folding said pizza box blank into a partially-erected non-wall-engaged carton using the following sub-steps (a) through (e):

(a) folding the left and right rear corner flaps to a position non-coplanar to the left and right side walls, (b) folding the left and right side walls to a position non-coplanar to the bottom panel, (c) folding the rear wall to a position non-coplanar to the bottom panel, (d) folding the cover panel to a position non-coplanar to the rear wall, and (e) folding the left and right cover side flaps to a position non-coplanar to the cover panel and with at least a portion of each of the cover side flaps disposed interior to the left and right side walls;

folding said partially-erected non-wall-engaged carton into said non-wall-engaged rectangular pizza carton using the following sub-steps (f) through (h):

(f) folding the front wall to a position non-coplanar to the bottom panel, (g) folding the ancillary panel to a position substantially parallel to the bottom panel and so that it overlies the front corner flaps; and (h) folding the cover panel to a substantially closed disposition;

opening said non-wall-engaged rectangular pizza carton into an opened non-wall-engaged rectangular pizza carton and placing a pizza therein; and folding said opened non-wall-engaged rectangular pizza carton into a fully-erected rectangular pizza carton loaded with pizza, said fully-erected rectangular pizza carton having (a) said left and right cover side flaps disposed interior to said left and right side walls, respectively, (b) said hingedly movable cover front flap disposed within said cover front flap engagement structure and disposed substantially parallel to said front wall, and (c) said front and rear corner flaps disposed substantially parallel to said front and rear walls, respectively.

2. The method of claim 1 further comprising the step of:

transporting said fully-erected rectangular pizza carton loaded with pizza, whereby said method of packaging and transporting pizza for improved efficiency and crush-resistance solves the problem of incurring one or more of the following four drawbacks commonly associated with packaging and transporting methods involving rectangular pizza cartons: (a) the box blank for the rectangular pizza carton is awkward and time-consuming to fold into the carton, (b) the ready-to-load format of the carton does not allow for unencumbered in-box pizza-cutting with a rocker knife and a pizza wheel due to the wall-engaged mode of the carton, (c) the ready-to-load format of the carton does not allow for unencumbered transfer of a pre-cut pizza into the carton due to the wall-engaged mode of the carton, and (d) the carton lacks left and right interior-disposed support-bearing cover side flaps and also front and rear corner flaps and, thereby, the carton fails to provide a level of folding efficiency and crush-resistance closely comparable to the level of folding efficiency and crush-resistance of a wall-engaged rectangular pizza box.

3. The method of claim 1 wherein:

said fully-erected rectangular pizza carton loaded with pizza is disposed in a non-wall-engaged mode whereby each of said rear wall, said left side wall structure, said right side wall structure, and said front wall structure is non-engaged to any wall structure of the carton.

4. The method of claim 1 wherein:

during the second folding step involving sub-steps (f), (g), and (h) said partially-erected non-wall-engaged carton is erectable into a first configuration and also into a second configuration, said first configuration having said cover front flap disposed outside of a holding cavity of said carton and free of engagement with said cover front flap engagement structure, said second configuration having said cover front flap disposed substantially parallel to said front wall and engaged within said cover front flap engagement structure;

wherein said carton maintains a closed erected disposition both after being formed into said first configuration and also after being formed into said second configuration.

5. A method of transporting a pizza, said method comprising the step of:

transporting said pizza in a non-wall-engaged rectangular pizza carton having interior-disposed support-bearing cover side flaps and comprising:

a substantially rectangular bottom panel having a predetermined front-to-rear length, a rear wall hingedly attached to said bottom panel, opposing left and right side wall structures comprising (i) respective left and right side walls hingedly attached to said bottom panel, (ii) respective left and right free-swinging front corner flaps hingedly attached to a front end of the side walls, and (iii) respective left and right free-swinging rear corner flaps hingedly attached to a rear end of the side walls, each of the side walls having a free top edge and a bottom edge length approximately equal to the predetermined front-to-rear length of said bottom panel, each of the corner flaps being free of locking engagement, a front wall structure comprising (i) a front wall hingedly attached to said bottom panel, (ii) an ancillary panel hingedly linked to a top edge of said front wall and having left and right free end edges, and (iii) a cover front flap engagement structure, and a cover structure comprising (i) a cover panel hingedly attached to said rear wall and (ii) a plurality of cover flaps comprising support-bearing left and right cover side flaps hingedly attached to respective left and right sides of said cover panel and a hingedly movable cover front flap attached at a fold line to a front edge of said cover panel;

wherein said carton is disposed in a non-wall-engaged mode, said support-bearing left and right cover side flaps are disposed interior to said left and right side walls, and said hingedly movable cover front flap is disposed within said cover front flap engagement structure and substantially parallel to said front wall, and wherein said fully-erected rectangular pizza carton further comprises at least one of the following structural enhancements:

(a) said left and right front corner flaps have a top edge disposed lower than the free top edge of said left and right side walls, respectively, (b) said ancillary panel is disposed substantially parallel to said bottom panel and said left and right free end edges are disposed in frictional contact with said left and right cover side flaps, respectively, (c) each of said left and right cover side flaps has a front-to-rear length approximately equal to the predetermined front-to-rear length of said bottom panel and has a recessed portion along an outer edge, said recessed portion extending all the way to a front edge of the cover side flap, (d) each of said left and right side walls is disposed at an obtuse angle to said bottom panel, and (e) at least one of the corner flaps has a bottom edge having an obtuse-angle-stabilizing tab projecting therefrom.

6. A method of packaging and transporting pizza, said method comprising the steps of:

providing a pre-folded non-wall-engaged rectangular pizza carton in opened disposition and comprising a set of components including:

a substantially rectangular bottom panel having a predetermined front-to-rear length, a rear wall, opposing left and right side wall structures comprising (i) respective left and right side walls each having a bottom edge length approximately equal to the predetermined front-to-rear length of said bottom panel and having a free top edge and (ii) free-swinging front and rear corner flaps attached to respective front and rear ends of the side wall, each of the corner flaps being free of locking engagement, a front wall structure opposing said rear wall and comprising (i) a front wall, (ii) an ancillary panel hingedly linked to a top edge of said front wall and having left and right free end edges, and (iii) a cover front flap engagement slot, and a cover comprising (i) a cover panel hingedly attached to said rear wall and (ii) a plurality of cover flaps comprising support-bearing left and right cover side flaps hingedly attached to respective left and right sides of said cover panel and a hingedly movable cover front flap attached at a fold line to a front edge of said cover panel, wherein each component of the set of components of said non-wall-engaged rectangular pizza carton is disposed in a non-erected position;

placing a pizza into said pre-folded non-wall-engaged rectangular pizza carton in opened disposition;

folding said pre-folded non-wall-engaged rectangular pizza carton in opened disposition into a partially-erected non-wall-engaged carton using the following sub-steps (a) through (c):

(a) folding the left and right side walls to a substantially upright position, (b) folding the rear wall to a substantially upright position, and (c) folding the cover panel to overlie the left and right rear corner flaps and folding the left and right cover side flaps to a position wherein at least a portion of the flaps is disposed interior to the left and right side walls;

folding said partially-erected non-wall-engaged carton into a fully-erected loaded non-wall-engaged carton using the following sub-steps (d) through (f):

(d) folding the front wall to a position non-coplanar to the bottom panel, (e) folding the ancillary panel to a position substantially parallel to the bottom panel and so that it overlies the front corner flaps; and (f) inserting the cover front flap into the cover front flap engagement structure, wherein in said fully-erected loaded non-wall-engaged carton (i) the left and right cover side flaps are disposed interior to the left and right side walls, respectively, (ii) the hingedly movable cover front flap is disposed within the cover front flap engagement structure and disposed substantially parallel to the front wall, (iii) the front and rear corner flaps are disposed substantially parallel to the front and rear walls, respectively, and (iv) the carton is in non-wall-engaged mode; and transporting said fully-erected loaded non-wall-engaged carton.

7. A method of erecting a box blank into a carton, said box blank being cut and scored into a set of components comprising:

a substantially rectangular bottom panel having a predetermined front-to-rear length, a rear wall attached to said bottom panel, opposing left and right side wall structures comprising (i) respective left and right side walls attached to said bottom panel and each having a bottom edge length approximately equal to the predetermined front-to-rear length of said bottom panel and having a free top edge and (ii) free-swinging front and rear corner flaps attached to respective front and rear ends of the side wall, a front wall structure opposing said rear wall and comprising (i) a front wall attached to said bottom panel and (ii) an ancillary panel hingedly linked to a top edge of said front wall, and a cover comprising (i) a cover panel attached to said rear wall and (ii) a plurality of cover flaps comprising left and right cover side flaps hingedly attached to respective left and right sides of said cover panel and a hingedly movable cover front flap attached to a front edge of said cover panel;

said method comprising the steps of:

folding said box blank into a partially-erected non-wall-engaged carton using the following sub-steps (a) through (e):

(a) folding the left and right rear corner flaps to a position non-coplanar to the left and right side walls, (b) folding the left and right side walls to a position non-coplanar to the bottom panel, (c) folding the rear wall to a position non-coplanar to the bottom panel, (d) folding the cover panel to a position non-coplanar to the rear wall, and (e) folding the left and right cover side flaps to a position non-coplanar to the cover panel and with at least a portion of each of the cover side flaps disposed interior to the left and right side walls; and folding said partially-erected non-wall-engaged carton into a fully-erected carton using the following sub-steps (f) through (h):

(f) folding the front wall to a position non-coplanar to the bottom panel, (g) folding the ancillary panel to a position substantially parallel to the bottom panel and so that it overlies the front corner flaps; and (h) folding the cover panel to a substantially closed disposition.

* * * * *